US006402556B1

(12) United States Patent
Lang et al.

(10) Patent No.: US 6,402,556 B1
(45) Date of Patent: Jun. 11, 2002

(54) FLEXIBLE CIRCUIT CONNECTOR FOR CIRCUIT BOARD APPLICATIONS

(75) Inventors: Harold Keith Lang, Fox River Grove; Martin Uche Ogbuokiri, Aurora; Steve Anil Shah, Lincolnwood, all of IL (US); Gregory D. Spanier, Shakopee, MN (US); Irvin R. Triner, Lemont, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/741,534

(22) Filed: Dec. 19, 2000

(51) Int. Cl.[7] ..... H01R 24/00
(52) U.S. Cl. ..... 439/632; 439/60
(58) Field of Search ..... 439/60, 65, 620, 439/632, 637, 493, 76.1, 629

(56) References Cited

U.S. PATENT DOCUMENTS 4,298,237 A * 11/1981 Griffith et al. ..... 439/60
4,795,897 A * 1/1989 Chalendard ..... 235/482
4,969,824 A * 11/1990 Casciotti ..... 439/62
5,196,994 A * 3/1993 Tamuma et al. ..... 439/60
5,726,432 A * 3/1998 Reichardt ..... 235/441
5,831,256 A * 11/1998 De Larminat et al. ..... 235/486
5,980,267 A 11/1999 Ayers et al. ..... 439/60
6,105,868 A * 8/2000 Reichardt ..... 235/441

* cited by examiner

*Primary Examiner*—Neil Abrams
*Assistant Examiner*—J. F. Duverne
(74) *Attorney, Agent, or Firm*—Thomas D. Paulius; A. A. Tirva

(57) ABSTRACT

An improved flexible circuit connector that is particularly useful in connections for circuit boards has a housing and a circuit card engaging assembly mounted therein. The circuit card engaging assembly includes at least two contact spring members having a U-shaped portion adjoining a body portion thereof such that when the two contact spring members are brought together at their body portions, a U-shaped channel is formed that supports two lengths of flexible circuity close to the surface and edge of a circuit board inserted into the connector channel.

22 Claims, 4 Drawing Sheets

FLEXIBLE CIRCUIT CONNECTOR FOR CIRCUIT BOARD APPLICATIONS

BACKGROUND OF THE INVENTION

The present invention relates generally to circuit board connectors and, more particularly to a circuit board connector that uses flexible circuitry to effect a connection to a printed circuit board.

The power requirements of many chips and other integrated circuits have increased over the years. Current microprocessors and ones under development operate at very high speeds and require more power to operate at their peak efficiency. In the past, such microprocessors have been mounted directly to a circuit board, typically the mother board of a computer or other electronic device. In these applications, voltage regulators and power components have been mounted on the circuit board in proximity to the microprocessors. This type of arrangement takes up valuable real estate on the circuit board. In other arrangements, a microprocessor may be mounted on a circuit card or an insertable and removable module that plugs into a connector mounted on the main circuit board (the mother board). In these type applications, the microprocessor is inserted in a connector and the card itself is inserted into a computer. The use of connectors raises the inductance and resistance of the overall system.

Most circuit board connectors in the art utilize through-hole pins or surface mount tails to provide a connection, rather than flexible circuitry, in which the pitch of the contacts can be effectively controlled and which can provide a heat sink for power connections. When connectors are used that rely solely upon stamped and formed terminals that are soldered to circuit boards, the resistance and inductance of the connector system tends to increase. As these factors increase, so does the total impedance of the connector system. A need therefore exists, especially in chip module applications, for a connector with reduced bulk resistance and inductance, that results in a lower connector system impedance.

The present invention is therefore directed to an improved connector that has a reduced inductance and resistance compared to the prior art.

SUMMARY OF THE INVENTION

Accordingly, it is an object of the present invention to provide an improved connector for that requires no solder connections, and has better thermal properties and a lower bulk resistance than connectors presently available in the prior art.

A further object of the present invention is to provide a connector for connecting a processor module to a circuit board, the connector having a housing for receiving an edge of the module circuit board and having one or more extents of flexible circuitry that are held in contact with conductive pads on the module circuit board and which mimic the profile of the insertion edge of the circuit board.

A still further object of the present invention is to provide a connector having a housing that encloses and supports three spring members to which are mounted three discrete extents of flexible circuitry, each having contact and portions that are disposed within the connector housing in opposition to respective power, signal and ground contact pads disposed on a module circuit board, whereby the flexible circuitry provides lower bulk resistance and an improved inductance for the connector.

Yet another object of the present invention is to provide a connector for use in providing a connection between a processor module and another circuit board, in which the connector includes a housing having a slot disposed therein to receive the end of a circuit board therein, the circuit board being the substrate of the processor module, a multi-part circuit card-engaging assembly being held within the housing, the card-engaging assembly including three contact spring members, each spring having a flat body portion that terminates in a spring arm, each contact spring supporting an extent of flexible circuitry thereon, two of the springs being held together as an assembly by a first mating bar, the remaining spring being held within a second mating bar, the first and second mating bars being engageable with each other so that the spring arms of the springs support the flexible circuity within the housing on opposite sides of a centerline of the insertion slot, for engagement with airways of conductive pads disposed on the circuit board.

Still another object of the present invention is to provide a connector with a contact assembly module that is insertable into a housing of the connector, the contact assembly having at least a pair of contact arms that are adapted to engage contact pads of a circuit board on opposite surfaces of the circuit board, the contact arms being formed as approximate mirror images of each other and each having a stepped body portion so that the contact arms cooperatively define a circuit board-securing cavity that emulates the configuration of the circuit board edge to thereby create a low profile within the connecting interface of the connector housing to thereby provide a lower inductance for the connector.

These objects are accomplished by the unique novel structure of the invention. In an important aspect of the present invention, the connector does not utilize stamped and formed terminals to substantially eliminate compliance problems. The connector also uses flexible circuitry that eliminates solder connections for better control of the impedance of the connector and the system in which it is used.

The flexible circuitry that effects the connection with the processor module circuit board does so in a manner so that the flexible circuitry adopts a profile that is closer to the profile of the circuit board, thereby reducing the inductance of the connector. The flexible circuitry has a lower bulk resistance that formed terminals and the amount of conductive metal used with the flexible circuitry is such that the conductivity and thermal properties can be increased. This profile is accomplished by the configuration of the contact spring members, which each include a flat body portion and a curved contact head portion which are interconnected together by a stepped, or recessed portion which cooperates with another recessed portion to define a channel of the connector. The contact head portions extend inwardly from the stepped portion and protrude into the channel formed between the contact spring members. This channel receives the edge of a circuit card therein in a manner so that the edge of the circuit card preferably abuts the step between the stepped portion and the body portion of each contact spring. The flexible circuitry is supported along this stepped portion so that it comes as close as possible to emulating the actual profile of the edge card, thereby reducing the inductance of the connector system.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DETAILED DESCRIPTION OF THE PREFERRED EMBODIMENT

Figure 1:
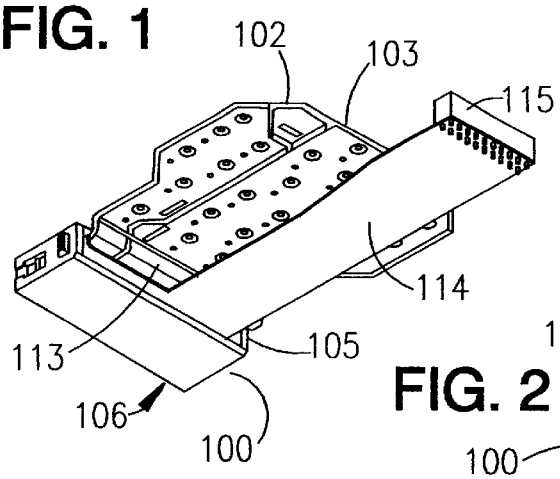
FIG. 1 is a perspective view of a connector assembly constructed in accordance with the principles of the present invention and illustrated attached to additional electronic components.
Figure 2:
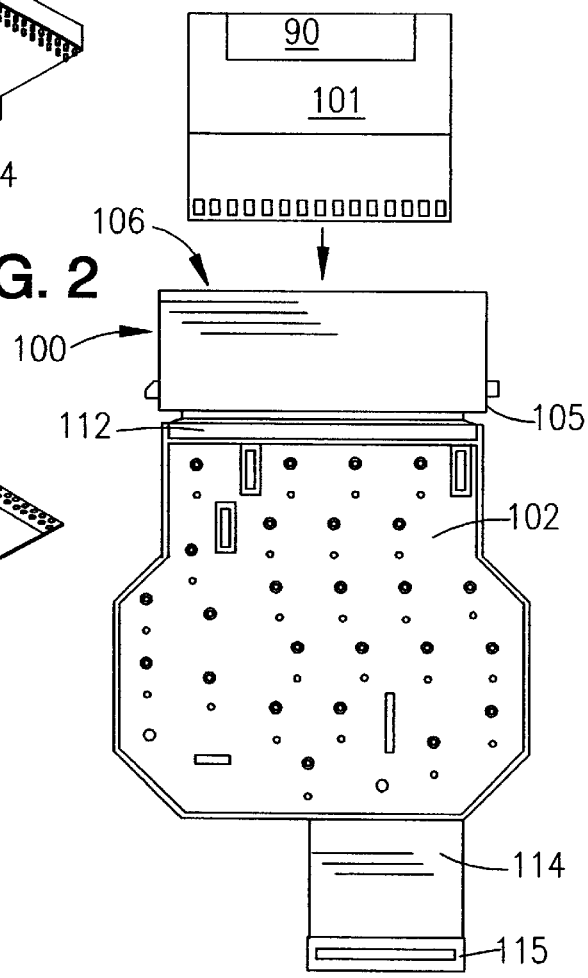
FIG. 2 is top plan view of the connector assembly of FIG. 1.

FIG. 1 illustrates generally a connector 100 construction in accordance with the principles of the present invention. Such a connector 100 may be beneficially used in specialized power interconnection applications, especially in applications wherein the connector is used to form a connection between a processor, such as a microprocessor 90, that is mounted as a module that includes a printed circuit board 101. (FIG. 2.) In the art, it is known to mount voltage regulators and power assisting components, such as capacitors onto the circuit board on which the processor is mounted, but this type of arrangement takes up valuable real estate on the circuit board. Additionally, it has been known in the art to use conventional edge card connectors to provide a connection to the processor module. The contacts used in such applications utilize terminals that are stamped and formed, which increases the overall cost of the connector system.

The connectors of the present invention provide an interconnection that may be used with lower inductances and bulk resistance than known connectors of the art. The connector 100 is illustrated as having two secondary circuit boards 102, 103 connected thereto in a spaced-apart relationship from each other along what may be considered as the rear face 105 of the connector 100. The opposing, or front face 106, of the connector is used to engage a circuit board, typically the edge of a circuit board module upon which is mounted a microprocessor or the like.

Figure 3:
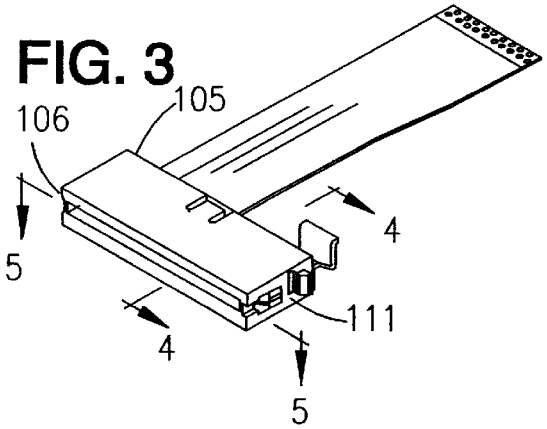
FIG. 3 is a perspective view of the connector of FIG. 1 with the electronic components removed.

The connector has an insulative housing 110 that as illustrated, preferably has a rectangular configuration. Along the front face 106 of the connector 100 (FIGS. 3–4), an insertion slot 111 is provided and it provides a means to communicate with the interior of the connector 100. The rear face 105 of the connector 100 is preferably open so as to permit the exit from the connector 100 of different lengths of flexible circuitry 112, 113 and 114. The housing 110 is preferably hollow, with an interior passage 108 extending therethrough between opposing front and rear faces, 105, 106 of the connector 100. This central passage 108 holds a card-engaging assembly 109 in place within the housing 110. The secondary circuit boards 102, 103 may contain certain components, such as capacitors and voltage regulators and the like.

FIG. 1 illustrates one application of the connector 100 where two secondary circuit boards 102, 103 are attached to two of the flexible circuitry extents 112 and 113, while the remaining flexible circuitry extent 114 has a surface mount connector 115 attached to its ends 117.

Figure 14:
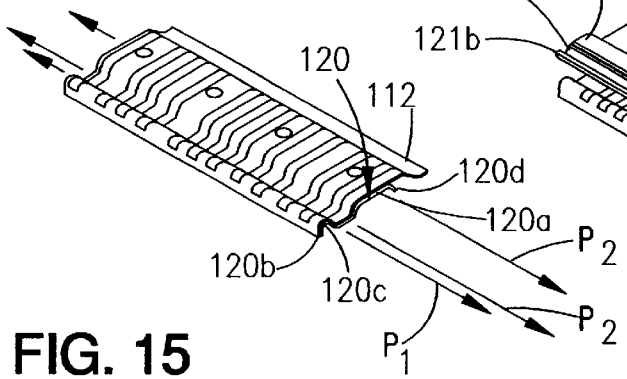
FIG. 14 is a perspective view of the bottom contact spring member of FIG. 13 with an extent of flexible circuitry supported thereon.
Figure 15:
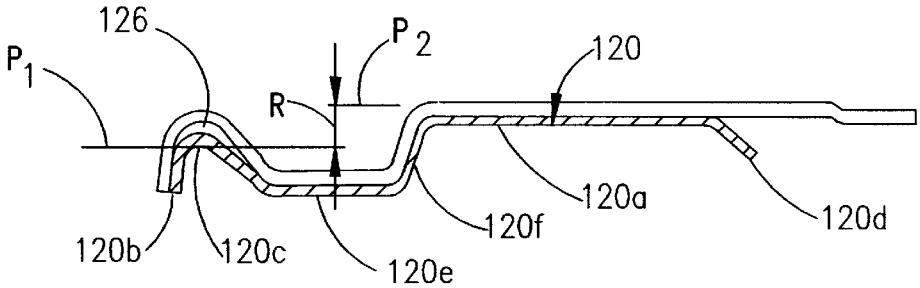
FIG. 15 is a side elevational view of the contact spring member of FIG. 14.

In an important aspect of the present invention, the flexible circuitry extents 112–114 are supported on two respective spring members 120–122 that are formed as part of a card-engaging assembly 109. As shown generally in FIGS. 4–17, each such spring member includes an elongated, generally planar body portion 120*a*–122*a* that terminates in a free end portion 120*b*–122*b*. Each such free end portion 120*b*–122*b* includes a curved contact head 120*c*–122*c* that is curved and which extends toward a centerline "C" of the card engaging assembly which may coincide with a centerline of the connector 100 and its connector housing insertion slot 111. As shown in FIGS. 14 and 15, the tips of the contact heads 120*c*–122*c* preferably extend in a plane $P_1$ that is spaced apart from the plane $P_2$ of the respective body portions 120*a*–122*a* and form a "crown" so as to provide a reliable contact force onto opposing contact pads disposed on opposite surfaces of a circuit board.

The contact head portions 120*c*, 121*c* are interconnected to their respective body portions 120*a*, 121*a* by intervening stepped, or diverging portions 120*e*, 121*e* that include portions at 120*f*, 121*f* which first extend in an offset or diverging manner, away from the centerline C of the channel 126 which may be considered as occurring along the same extent as the two opposing exterior surfaces of the flexible circuitry extents 112, 113 that abut each other along the body portions 120*a*, 121*a* of the contact spring members 120, 121. The contact spring members then next extend generally parallel along portions 120*e*, 121*e* before they terminate in the free end portion 120*b*, 121*b*.

Figure 16:
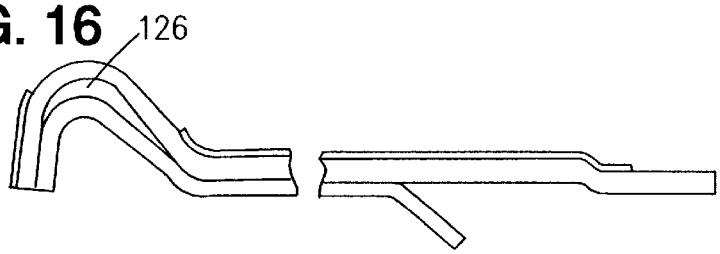
FIG. 16 is an enlarged detail elevational view of the contact spring member of FIG. 15; and, FIG. 17 is a diagrammatic, sectional view of a circuit card inserted into the connector of the present invention.

Each of the spring members 120–122 supports a single extent of flexible circuitry 112–114 in what may be considered as intimate contact by way of adhesive or other manner of bonding so that the flexible circuity extents 112–114 will follow the contour of the spring members 120–122. In order to facilitate engagement of the connector to various circuit boards and ensure good contact compliance, each spring member 120–122 as illustrated in FIGS. 15 and 16, may include an elastomeric layer 126 supported thereon that is interposed between the flexible circuitry and the contact spring members in the area of the contact head portions 120*c*–122*c*. This elastomeric layer 126 assists in increasing the compliance factor of the connector inasmuch as it is deformable under pressure and facilitates reliable engagement with circuit cards that may be out of tolerances.

Figure 4:
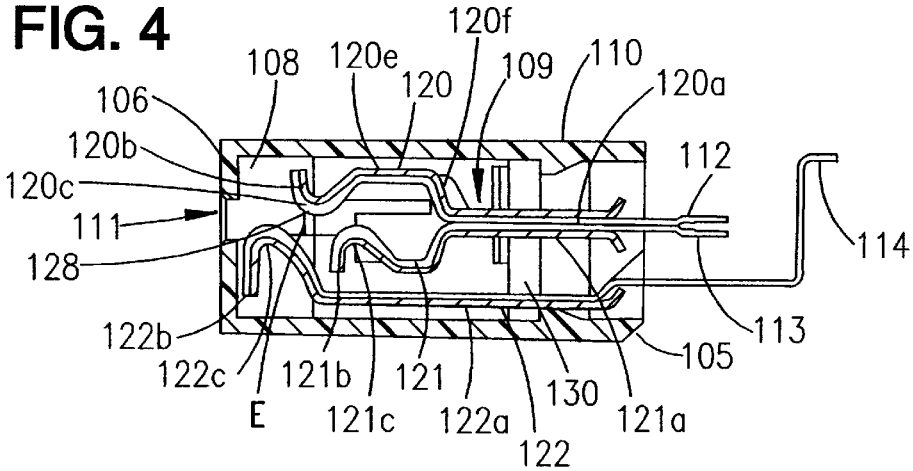
FIG. 4 is a vertical cross-sectional view of the connector of FIG. 3, taken along lines 4—4 thereof.
Figure 5:
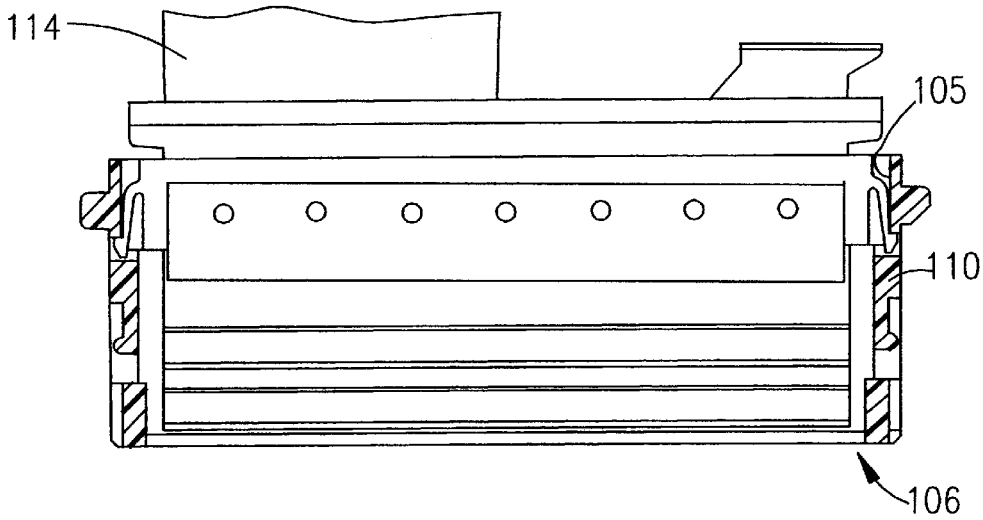
FIG. 5 is a horizontal cross-sectional view of the connector of FIG. 3, taken along lines 5—5 thereof.
Figure 6:
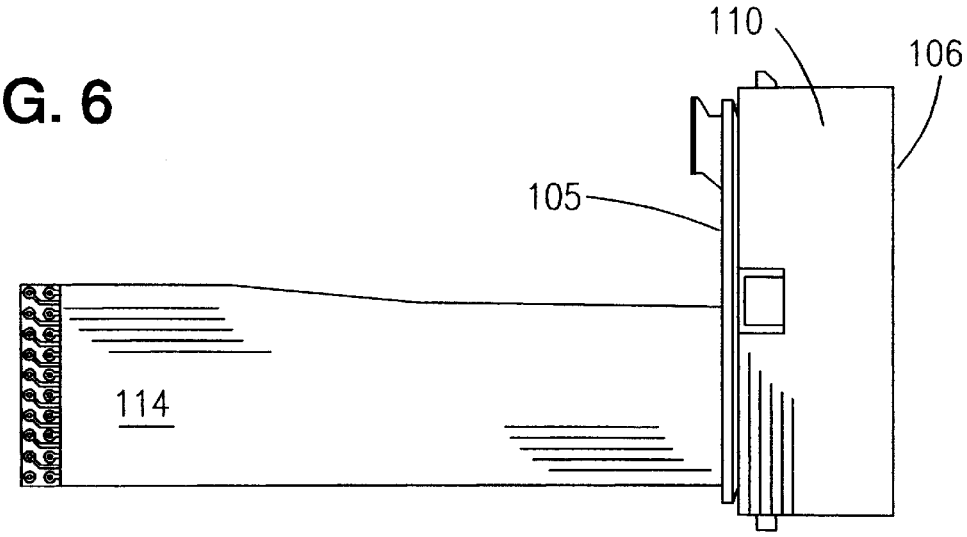
FIG. 6 is a top plan view of the connector of FIG. 3.
Figure 7:
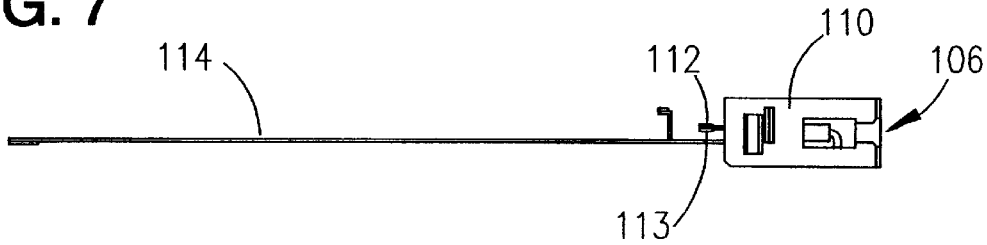
FIG. 7 is side elevational view of the connector of FIG. 6.
Figure 17:
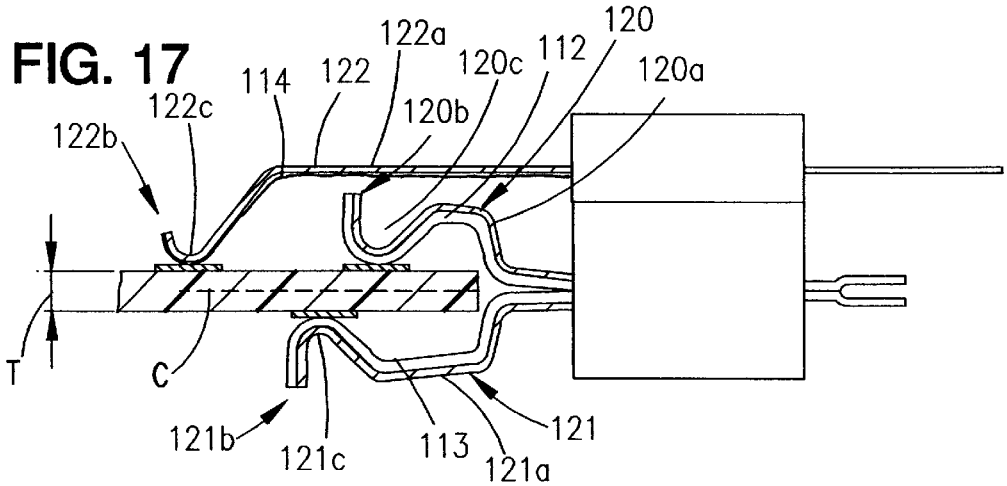

Two of the contact spring members 120, 121 are aligned in opposition with each other and are closely spaced together along their body portions 120*a,* 121*a.* The body portions 120*a,* 121*a* end in tail portions 120*d,* 121*d* that diverge therefrom in the same direction as their associated respective contact head portions 120*c,* 121*c.* The diverging portion 120*e,* 121*e* of the two contact spring members 120, 121 define a channel 128 by virtue of their offset nature. This channel 128 receives the edge of a primary circuit board 101 therein. The contact head portion 120*c,* 121*c* extend into this channel 128 as illustrated. When the circuit board 101 is inserted into this channel 128, the contact head portions 120*c,* 121*c* deflect slightly outwardly under the pressure of the circuit board inasmuch as the thickness T of the circuit board is greater than the at rest spacing E between the two contact head portions 120*c,* 121*c* as illustrated in FIG. 4. In this manner and as illustrated in FIG. 17, the flexible circuitry extents 112, 113 are held more closely along the profile of the circuit board approaching the ideal condition where the flexible circuitry would follow the circuit board contour exactly as if it were adhered to the exterior surfaces of the circuit board. In this regard, the flexible circuitry is supported on the contact spring member 120*e,* 121*e* and 130*c,* 120*f* so that it extends along the insertion edge of the circuit board and a short distance along the circuit card.

This contour-following aspect and the cantilevered nature of the contact spring members lowers the inductance of the connection made between the connector and the circuit board. The contour-following aspect of the connector 100 is established by the structure of the two contact spring members 120, 121. As mentioned previously, each of the contact spring members 120, 121 has a stepped portion that serves to define a support surface that is U-shaped at what may be considered to be the "bottom" of the card-receiving channel 126 that serves to support the flexible circuitry extents in a U-shaped configuration that closely approaches the actual configuration of the circuit card edge. The contact spring members 120–122 are preferably formed from copper or an alloy thereof, which have excellent thermal characteristics and therefore serve as a heat sink for power applications.

For the card-engaging assembly 109, two of the three contact spring members 120, 121 are first placed into opposition with each other along their respective body portions 120*a,* 121*a.* These two contact spring members 120,121 support two separate extents of flexible circuitry 112, 113 thereon, and as is known in the art, the flexible extents 112, 113 extend from the free ends 120*b,* 121*b* to and past the body portions 120*a,* 121*a.*

Figure 8:
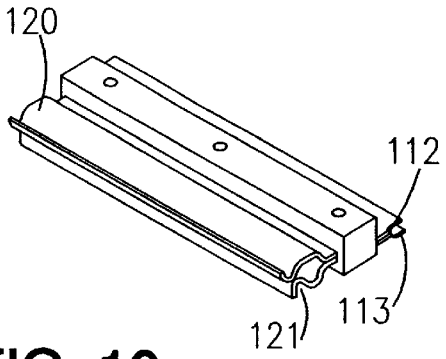
FIG. 8 is a perspective view of one of the two card-engaging assembly components used in the connectors of the present invention.
Figure 9:
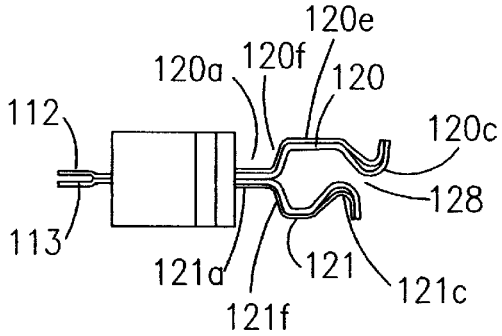
FIG. 9 is a side elevational view of the first card-engaging assembly of FIG. 8.
Figure 10:
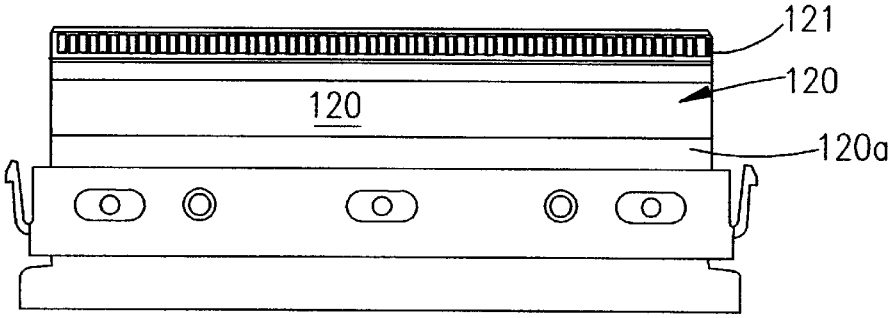
FIG. 10 is a top plan view of the first card-engaging assembly of FIG. 7.
Figure 13:
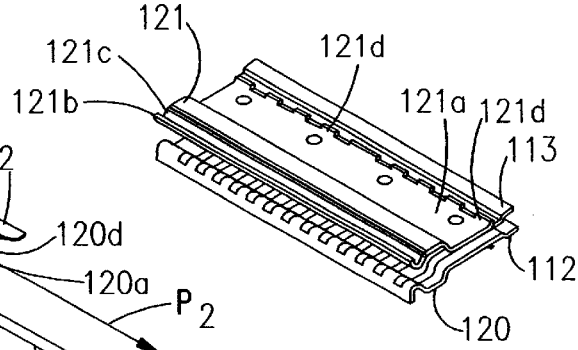
FIG. 13 is a perspective view of the two contact spring members which are used in the first card-engaging assembly of FIGS. 8–10 and with extents of flexible circuity supported thereon.

As shown in FIG. 8, the two contact spring members and the associated flexible circuitry extents 112, 113 may be integrated together by orienting two of the three contact spring members 120, 121 and their associated flexible circuitry extents 112, 113 in opposition with each other as shown in FIG. 13, where the body portions 120*a,* 121*a* thereof abut each other, separated by the flexible circuitry which they support. The two contact spring members 120, 121 are preferably held together in this orientation by overmolding a support 130, shown as an elongated bar member, that extends widthwise of the contact spring members 120, 121. This first support 130 serves two purposes. One purpose is to hold the body portion in place so that the contact head portions 120*c,* 121*c* of the contact spring members 120, 121 extend longitudinally therefrom in a cantilevered fashion. This cantilevered structure imparts a measure of flexibility to the contact head portions 120*c,* 121*c* of the two contact spring members 120, 121, which reduces the insertion force required to insert a circuit card into the connector 100.

Figure 11:
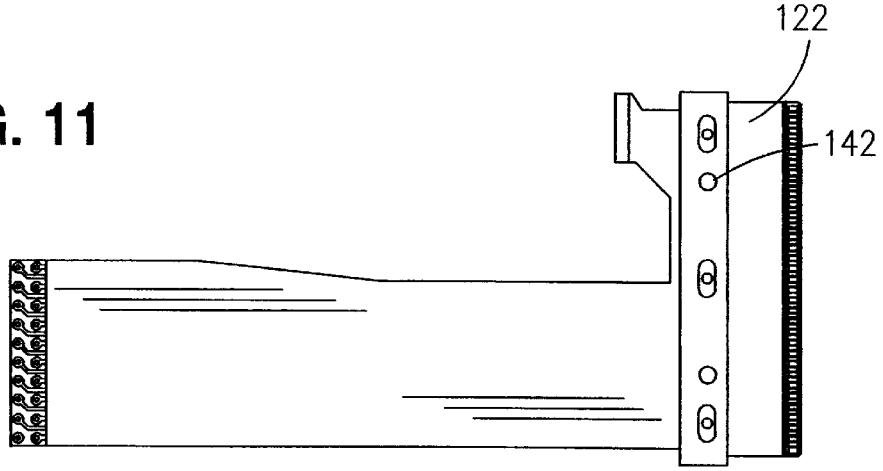
FIG. 11 is a top plan view of a second card-engaging assembly used in the connectors of the invention.
Figure 12:
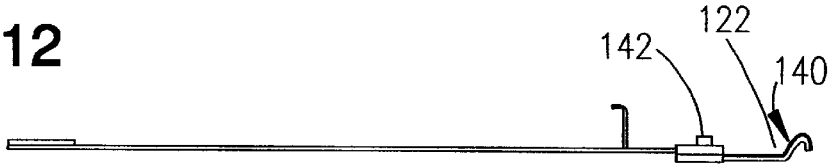
FIG. 12 is a side elevational view of the second card-engaging assembly of FIG. 11.

The second purpose of the support 130 is to provide a means for engaging the connector housing 110 and supporting the card-engaging assembly 109 in place therein, as well as supporting the third contact spring member 122. As shown in FIG. 11, this third contact spring member 122 also supports an extent of flexible circuitry 114 on its card-engaging surface 140, and also includes a second support 131 that is dimensioned similar to the first support 130. This second support 131 also preferably has the shape of a bar that is overmolded to the spring member 122 and also extends widthwise of the spring member. Posts 142, or other suitable means, may be provided to facilitate the engagement of the second support base 131 with the first support base 130. The two supports 130, 131 preferably have similar lengths and width so they may be combined into a single support bar for the entire card-engaging assembly 109.

As mentioned above, the connector 100 includes an outer insulative housing 110 with an interior passage 108 that receives the card-engaging assembly 109 therein. One of the two support bases, shown as 130, may include at its opposite ends, a pair of engagement arms 132 that extend out from the support base 130 and which terminate in angled engagement heads 133. The connector housing 110 has a similar pair of engagement arms 135 formed thereon and oriented in an opposite direction to the support base engagement arms 132. These engagement arms 135 may be formed as part of the housing sidewalls 136 and may be surrounded by slots 137 to increase their flexibility. They extend in a direction opposite that of the support base engagement arms so that their common engagement heads will engage each other when the card-engaging assembly 109 is inserted into the connector housing 110.

It will be understood that with connectors of the present invention, the overall system inductance and bulk resistance are lowered. The use of soldered joints between the processor module, (its circuit board) is eliminated and the connector is directly effected between the processor module circuit board and the flexible circuitry. The use of flexible circuitry also grants the system improved thermal performance in that the construction of the flexible circuitry is such that it uses a large amount of copper in its traces, which has a high thermal conductivity, that alone or in concert with the contact spring members, may serve as a heat sink for the connector. In addition, the use of flexible circuitry as the contacts of the connector permits the use of wide ground paths in the flexible circuitry as well as wide power conducting traces.

While the preferred embodiment of the invention have been shown and described, it will be apparent to those skilled in the art that changes and modifications may be made therein without departing from the spirit of the invention, the scope of which is defined by the appended claims.

We claim:

1. A connector for engaging a circuit board of the type having three distinct sets of contact pads disposed thereon in three distinct, spaced apart locations on the circuit board, said circuit board further having an edge of preselected length, the three sets of contact pads being spaced from said circuit board edge, the connector comprising:

a housing, the housing having a hollow body portion with an interior passage extending through said housing, said housing further having first and second opposing faces, the first face of which includes a circuit board-receiving slot formed therein that communicates with said housing interior passage;

a circuit board engaging assembly disposed within said housing interior passage, the circuit board engaging assembly including at least first and second contact spring members, each of said first and second contact spring members including a body portion, an offset portion and a contact portion terminating in a contact head, the body portions of said first and second contact spring members abutting each other and the offset portions of said first and second contact spring members increasing a spacing therebetween so that said first and second contact spring member contact portions are spaced apart from each other to define a circuit board-receiving channel of said connector; and, first and second extents of flexible circuity supported on opposing surfaces of said first and second contact member body portions, offset portion and contact portions on opposite sides of a centerline of said circuit board-receiving channel, said first and second contact spring member contact heads being spaced apart from each other lengthwise of said connector.

2. The connector of claim 1, wherein said first and second contact spring member offset portions interconnect respective contact and body portions thereof, and diverge away from each other to cooperatively impart a general U-shape to said circuit board-receiving channel.

3. The connector of claim 2, wherein said flexible circuitry extents respectively extend continuously along said first and second contact spring members from said contact portions thereof to past said body portions thereof.

4. The connector of claim 1, wherein each of said first and second contact spring member offset portions extend away from their respective body portions and subsequently parallel to said body portions to mate with said contact portions.

5. The connector of claim 4, wherein said contact spring member offset portions diverge away from said associated body portions at an angle therefrom.

6. The connector of claim 5, wherein said contact spring member offset portions diverge away from said associated body portions at approximately a right angle therefrom.

7. The connector of claim 1, wherein said first and second contact spring members are held together in said abutting contact by a first support that extends transversely to said contact spring members.

8. The connector of claim 7, wherein said first support is molded around said first and second contact spring member body portions.

9. The connector of claim 7, wherein said first support has at least two engagement arms formed therewith and extending therefrom, for engaging said housing.

10. The connector of claim 7, wherein said first and second contact spring members and said first support cooperatively form a first circuit card-engaging assembly of said connector.

11. The connector of claim 9, where said housing has a pair of endwalls and each of said endwalls includes a shoulder that engages said support base engagement arms.

12. The connector of claim 1, further including a third contact spring member, the third contact spring member also having a body portion and a contact portion with a contact head disposed at an end thereof, the third contact spring member overlying one of said first and second contact spring members.

13. The connector of claim 12, wherein said third contact spring member has a length greater than either of said first and second contact spring members.

14. The connector of claim 12, further including a second support that extends transversely across said third contact spring member, the second support engaging said first support.

15. A connector for providing a connection between a processor module and a circuit board, the processor module including a circuit board that supports the processor, the circuit board having an insertion edge with a plurality of contact areas disposed thereon in proximity to the insertion edge, the connector comprising:

a support bar, the support bar supporting three contact arms, each of the contact arms extending for substantially the entire length of said support bar, two of said three contact arms being bent to cooperatively define together a general U-shaped circuit board-receiving recess for receiving said circuit board insertion edge, three extents of flexible circuitry being supported on surfaces of said three contact arms that face toward the circuit board-receiving recess so as to oppose said circuit board contact areas when said circuit board is inserted into said circuit board receiving recess, two of said three extents of flexible circuitry being respectively supported on two of said three contact arms, each of said two contact arms further cooperatively emulating the configuration of said circuit board insertion edge, said three contact arms further including respective contact heads at free ends thereof extending toward a centerline of said circuit board-receiving recess, the contact heads being offset from each other so as to make electrical contact with three respective opposing contact areas of said circuit board; and a housing enclosing said contact arms and support bar, said housing having a slot formed therein that is aligned with said circuit board-receiving recess.

16. The connector of claim 15, wherein each of said contact arms is formed from copper or an alloy thereof.

17. The connector of claim 15, wherein each of said two contact arms include a body portion embedded in said support bar and a diverging portion that interconnects said body portion with said contact head thereof.

18. The connector of claim 15, wherein said support bar removably engages said housing.

19. The connector of claim 15, wherein said flexible circuity extents extend along said surfaces of said contact arms from said contact heads through said support bar and further exit from said support bar for predetermined lengths to define termination portions of said flexible circuitry extents.

20. The connector of claim 15, wherein said support bar is molded onto said two contact arms.

21. The connector of claim 15, wherein said three contact arms extend from said support bar in a cantilevered fashion.

22. A connector for engaging a circuit board with three distinct sets of contact pads disposed thereon in three distinct, spaced-apart locations on the circuit board, said circuit board further having an edge of preselected length, the three sets of contact pads being further spaced from said circuit board edge, the connector comprising:

a housing, the housing having a hollow body portion with an interior passage extending through said housing, said housing further having first and second opposing faces, the first face of which includes a circuit board-receiving slot formed therein that communicates with said housing interior passage;

a circuit board-engaging assembly disposed within said housing interior passage, the circuit board-engaging assembly including at least first and second contact spring members that cooperatively define a circuit board-receiving channel of said circuit board-engaging assembly, each of said first and second contact spring members including a body portion, an offset portion and a contact portion terminating in a contact head, the body portions of said first and second contact spring members abutting each other, the offset portions of said first and second contact spring members being spaced apart from each other by first extending away from their respective body portions and then extending parallel to each other to meet with their respective contact portions; and first and second extents of flexible circuity supported on opposing surfaces of said first and second contact member body portions, offset portion and contact portions on opposite sides of a centerline of said circuit board-receiving channel.

* * * * *